US009957676B2

(12) United States Patent
Kollegger et al.

(10) Patent No.: US 9,957,676 B2
(45) Date of Patent: May 1, 2018

(54) ROADWAY JOINT DEVICE

(71) Applicant: TECHNISCHE UNIVERSITÄT WIEN, Vienna (AT)

(72) Inventors: Johann Kollegger, Klosterneuburg (AT); Bernhard Eichwalder, Gars am Kamp (AT)

(73) Assignee: TECHNISCHE UNIVERSITÄT WIEN, Vienna (AT)

( * ) Notice: Subject to any disclaimer, the term of this patent is extended or adjusted under 35 U.S.C. 154(b) by 113 days.

(21) Appl. No.: 14/768,455

(22) PCT Filed: Feb. 10, 2014

(86) PCT No.: PCT/EP2014/052525
§ 371 (c)(1),
(2) Date: Nov. 9, 2015

(87) PCT Pub. No.: WO2014/128017
PCT Pub. Date: Aug. 28, 2014

(65) Prior Publication Data

US 2016/0108587 A1 Apr. 21, 2016

(30) Foreign Application Priority Data

Feb. 19, 2013 (AT) ..... A 50111/2013

(51) Int. Cl.
*E01D 19/06* (2006.01)
*E01C 11/02* (2006.01)

(52) U.S. Cl.
CPC ..... *E01D 19/06* (2013.01); *E01C 11/02* (2013.01); *E01D 19/062* (2013.01); *E01D 19/067* (2013.01)

(58) Field of Classification Search
CPC ..... E01D 19/06; E01D 19/062; E01D 19/067; E01C 11/02
See application file for complete search history.

(56) References Cited

U.S. PATENT DOCUMENTS 3,165,986 A * 1/1965 Hirst ..... E01C 11/126 404/47
3,466,987 A * 9/1969 Shimizu ..... E01D 19/06 14/73.1

(Continued)

FOREIGN PATENT DOCUMENTS

DE 653375 C 11/1937
DE 1184368 B 12/1964

(Continued)

OTHER PUBLICATIONS

International Search Report & Written Opinion, dated Aug. 28, 2014, for PCT/EP2014/052525; Translation of International Search Report & Written Opinion, dated Aug. 28, 2014, for PCT/EP2014/052525.

*Primary Examiner* — Abigail A Risic
(74) *Attorney, Agent, or Firm* — Joseph G. Chu; JCIP

(57) ABSTRACT

A roadway joint device for providing a drivable joint section between a road and an adjoining structure, particularly a bridge structure, includes at least one joint element placed on a sliding surface adjacent to the bridge structure. A longitudinal axis of the joint element is arranged substantially parallel to a plane of the roadway and a bridge end section of the bridge structure. Joint gaps with a specified gap width are arranged between the joint element and the adjoining bridge end section and/or an adjoining retaining device arranged at a distance to the bridge end section. The joint element is attached to at least one rod, the rod being arranged substantially in the direction of the longitudinal axis of the bridge structure, anchored at one rod end in the bridge structure and another rod end thereof in the retaining device.

12 Claims, 4 Drawing Sheets

(56) References Cited

U.S. PATENT DOCUMENTS

| | | | | |
|---|---|---|---|---|
| 3,797,952 | A * | 3/1974 | Pommerening | E01D 19/062 14/73.1 |
| 3,880,540 | A | 4/1975 | Rizza et al. | |
| 3,899,261 | A * | 8/1975 | Mieville | E01D 19/06 14/73.1 |
| 3,904,302 | A * | 9/1975 | Bertschmann | E01D 19/062 404/68 |
| 4,030,156 | A * | 6/1977 | Raymond | E01D 19/06 14/73.1 |
| 4,569,615 | A * | 2/1986 | Goldman | E01D 19/06 14/73.1 |
| 5,664,906 | A | 9/1997 | Baker et al. | |
| 8,351,687 | B1 * | 1/2013 | Bradford | E01D 19/062 14/73.5 |
| 8,790,038 | B2 * | 7/2014 | Stachowicz | E01C 11/02 404/47 |
| 2008/0148499 | A1 * | 6/2008 | Bradfopd | E01D 19/062 14/73.5 |
| 2011/0217119 | A1 * | 9/2011 | Bradford | E01D 19/062 404/47 |

FOREIGN PATENT DOCUMENTS

| | | | |
|---|---|---|---|
| DE | 4425037 | C1 | 11/1995 |
| EP | 0149697 | A1 | 7/1985 |
| FR | 2717512 | A1 | 9/1995 |
| JP | 11152707 | A | 6/1999 |
| WO | 0079055 | A1 | 12/2000 |

* cited by examiner

ROADWAY JOINT DEVICE

The invention relates to a roadway joint device having the features of the preamble of claim 1.

From prior art there are known various variants of drivable roadway joint devices, which are intended to compensate for physically conditioned movements of walkable or drivable structures like bridges in regard to immediately adjoining roads. Reasons for such deformations of bridges usually are temperature changes as well as creeping and shrinking processes of the construction material used. Usually, concrete is used for the construction of bridges or comparable walkable or drivable structures, respectively. Primarily, the deformations are changes in length, which have to be absorbed and compensated for by the roadway joint device. In individual cases, roadway joint devices also have to absorb, apart from the main movement in the longitudinal direction of the bridge, also transversal shifts and twists of the drivable structure. As substantial requirements of a roadway joint device there are to be noted sealing against water and dirt to the greatest extent possible, simple accessibility for maintenance works, possibly low noise emissions when being driven over as well as long service life of all individual components of the joint device.

Immediately adjacently to the roadway joint device, there are usually installed in the roadway joint support strips in order to compensate for differences in rigidity of the adjoining road and the roadway joint device. Such joint support strips, which form a closing-off between the road usually provided with a bituminous road cover or a concrete cover and the adjoining roadway joint device, usually include shoulders made from corrosion-resistant steel. In order to prevent the steel shoulders fixed substantially transversally to the road direction from beginning to project beyond the level of the roadway and cars driving over from being hindered, there has been required so far that the upper edges of the shoulders end about 3 to 5 mm underneath the level of the road cover or the upper surface of the joint support strip, respectively. There is further to be ensured that in the area of the road joint no water may reach the load-bearing concrete situated underneath the support strips, which makes necessary a complex sealing in this area. In order to meet all these requirements, in the production of roadway joint structures it is necessary to work absolute precisely, which in general requires the use of specialists, wherein roadway joint devices currently known on the market usually have to be manually produced. The production of roadway joint devices, hence, is not only expensive but rather also time-consuming. Further, the currently used roadway joint devices usually have a significantly increased roadway cover installation, which will result in a bad driving experience when driving over the roadway joint device and in comparably high noise emissions. Problems also arise when polymer concrete beams are used as joint support strips. Such beams made from polymer concrete indeed have a high rigidity and, hence, are less prone to the occurrence of wheel ruts due to great wear. Such polymer concrete beams, however, are usually not elastic enough so that the installation thereof will lead to serious problems, frequently to the development of cracks either within the polymer concrete itself or in the transition area to the neighbouring roadway cover, through which water may enter and the load-bearing concrete situated underneath will be damaged.

Dependent on the length and width of the bridge of the joint to be bridged, there are currently used various roadway joint devices, which are briefly described in the following.

Roadway joint structures having a so-called integrated expansion section may be used for bridging expansion joints up to 100 mm. At roadway edges, for this reason, there are arranged respectively two angular sections serving as shoulder protection. On these galvanized steel sections there are applied two form sections, into which the expansion section may be slid in or may be buttoned in, respectively.

Further there are used so-called padding roadway joint structures, which bridge the gap area between the road and the adjoining bridge by way of a ductile sealing element adapted to traffic loads. The padding constructions have the advantage that these may perform shifts as well as twists of the bridge structure in regard to the road in all coordinate directions. The rigidity of the padding material is crucial for motion resistance. Padding constructions without intermediary sections are configured for a smaller range of motion, and these are in particular used to cover movement joints having a joint width of 40 to 80 mm. In the case of larger ranges of movement of up to 200 m, there are used additional intermediary sections or cantilever constructions. As a padding material there are used high-quality polymer materials, with chloroprene rubber or natural rubber materials being usually used. In order to improve the distribution of the load-exerting factors and to increase the bearing strength, the polymer materials may be reinforced using in-vulcanized steel elements.

In the case of finger roadways joint structures a so-called finger structure will assume the function of bridging. This is composed of two metal plates, which are finger-like intertwined at the opposite longitudinal sides thereof and which each are attached between the road and the bridge structure. The sealing function may be realized by means of a water pipe arranged underneath the intertwined metal plates or by means of a water-repellent sealing system.

Projecting finger structures are in general used for a range of motion of the joints to be bridged having expansion paths of 100 to 200 mm.

From prior art there are also known roadway joint devices having spring-mounted joint elements. From the document U.S. Pat. No. 3,880,540 A, for example, there may be learned a roadway joint structure, in which joint elements are connected with each other by way of spring elements. For this reason, several spring elements are arranged in series on a crossbeam. If the gap width between abutment and bridge is changed, these spring elements will be stretched or compressed.

The roadway joint known from the document DE 44 25 037 C1 works according to a similar principle. Joint elements are therein connected with each other in an elastic way, wherein several spring elements made from an elastomeric material are arranged in series for mounting. If the gap widths are changed, there will be developed shear deformation in the spring elements.

For very long bridge structures there is usually necessary a relatively wide joint structure. Roadway joint devices made from lamellae may be used for a joint width of up to 500 mm. The lamella structure thereby is composed of a primary support structure in parallel to the driving direction and a secondary support structure orthogonal to the driving direction, which is directly driven over. These roadway joint devices fundamentally are composed of one or several sealing elements, steel shoulder sections and, if required, controlled intermediary steel sections, which are mounted on movable support structures. These support structures may be constructively configured from specific clipper elements or from crossbeams or projection beams, respectively. Roadway joint devices from lamellae may be assembled on the basis of a modular principle, efficiently adapting to the characteristics of the structure. The number of intermediary sections results from the absorbable expansion path per sealing section.

Such a lamella structure for a roadway joint has been known already, for example, from the document WO 00/79055 A1. Thereby, changes in length of the bridge structure are compensated for by changes of the gap widths between abutment and bridge, without longitudinal pressures being exerted on the individual components of said structure.

The currently known roadway joint devices, however, are expensive in their production and are considered the most maintenance-intensive installations in bridge engineering. In the life cycle of a bridge structure these have to be subjected to maintenance works on a regular basis and usually be replaced several times, which, apart from negative effects on the traffic due to maintenance and restoration works, also represents high financial efforts. Due to a high chemical stress due to the influence of thawing agents, wheel wear as well as motor fuels and lubricants there are required, apart from the technical bridging of the roadway joints, also additional appropriate sealings of the joints, which in the currently used structures are installed in the course of the roadway joint construction or which require additionally performed sealing constructions. In many currently used sealing systems these are rather complex structures, which in general have their origin in mechanical engineering and usually each have numerous joint connections that are prone to failure. Such sealing systems thus are expensive and complex in the production as well as in the maintenance thereof.

An additional parameter that is to be considered is the fulfilment of the sonical requirements. If roadway joint structures are used, in which there is, for example, used a softer material for bridging the continuous transversal joints, then there may be developed a not acceptable noise stress due to the vertical jolt that will arise when driving over the roadway joint construction.

Further in the currently used systems the roadway area, which immediately adjoins the roadway joint device, is heavily stressed. This will usually lead to the formation of cracks in the asphalt and, hence, to destruction of the asphalt cover layer as well as to damage to the load-bearing layers situated underneath. The roadway cover in the transition area of the roadway joint structure has to be replaced on a regular basis due to occurring problems mentioned, at least in intervals of several years, which constitutes a further disadvantage of currently known roadway joint constructions.

Thus it is the task of the present invention to provide a roadway joint device, which in comparison with embodiments currently known from prior art has an improved service life and simultaneously reduced maintenance requirements and which enables for the provision of a continuous roadway in the area of a roadway joint device for concrete roadways as well as for bituminous roadways.

This task is solved by a roadway joint device having the features of the preamble of claim 1 by the features indicated in the characterizing part of the claim 1. Advantageous embodiments and developments of the invention are indicated in the sub-claims.

In an inventive roadway joint device for providing a drivable joint section between a road and an adjoining drivable structure, in particular a bridge structure, wherein the various deformations of the road and the adjoining structure may be compensated for by the roadway joint device, there is placed on a sliding surface adjacently to the bridge structure at least one joint element, wherein the longitudinal axis of the at least one joint element is arranged substantially parallel to a plane of the roadway as well as substantially parallel to a bridge end section of the bridge structure, and joint gaps with a specified gap width are arranged between the at least one joint element and the adjoining bridge end section and/or an adjoining retaining device, which is arranged at a distance to the bridge end section within or underneath the plane, wherein the at least one joint element is attached to at least one rod by compound effect between rod and joint element, whereby compound tensions may be transferred in a uniformized way from the rod to the at least one joint element attached thereto, said rod being arranged substantially in the direction of the longitudinal axis of the bridge structure and being anchored in the bridge structure at one rod end thereof using an anchoring and in the retaining device at the other rod end thereof using an anchoring.

By attaching the at least one joint element to at least one rod, which is arranged approximately in the longitudinal direction of the bridge structure between the bridge structure and the retaining device and which is anchored with the rod ends thereof respectively in the bridge structure as well as in the retaining device, there is ensured that in the case of a change of the length of the bridge structure there are introduced tensile and pressure forces from the bridge structure into the at least one rod, whereby the joint elements attached thereto are uniformly moved along. In the inventive embodiment of a roadway joint device there is existent in the case of an expansion or compression of the at least one rod in each joint element an area, in which there does not occur any relative shift between rod and joint element and at which the joint element is attached at the rod in a stationary way. The joint elements therefore rest on a sliding surface between the bridge structure and the retaining device. In this way, an entire gap width of a larger joint gap, which has to remain free as a consequence of the length change of the bridge structure changing, will advantageously be distributed onto several small joint gaps with respectively smaller gap widths between the bridge structure, the retaining device and the joint elements arranged in-between. In particular in embodiments with several joint elements the variable gap widths between the components of an inventive roadway joint device may advantageously be configured to be especially small. Small transversal grooves in the roadway in the area of the joint gaps of the roadway joint device are thus being driven over substantially without any reduction of the driving experience. Within the scope of the invention it is further possible due to the several small joint gaps to provide an elastic road cover, for example an asphalt cover layer, also in the area of the roadway joint device continuously as well as substantially without any cracks.

In a roadway joint device according to the invention there are advantageously placed two or several joint elements substantially parallel to each other, wherein the longitudinal axes of each joint element are each arranged substantially parallel to a plane of the roadway as well as substantially parallel to a bridge end section and wherein joint gaps with a specified gap width are arranged between the joint elements, wherein the joint elements are connected with each other by at least one rod, which is attached to at least every individual joint element. In this embodiment the two or several joint elements, which are each attached to the at least one rod, are moved uniformly on the sliding surface by the pressure and tensile forces acting when the length of the bridge is changed. In this way, there is achieved a uniform distribution of the entire gap width onto the several joint gaps. The movement of the joint elements in the case of a change of the length of the adjoining bridge structure may be compared, for example, to the movement of the bellows of an accordion, wherein, also due to tensile stress, the intervals between the edges of the bellows are increased—analogously to the joint gaps between several joint elements—and wherein in the case of a pressure load the intervals between the edges of the bellows are uniformly reduced.

In an inventive roadway joint device the joint elements are usually configured substantially cuboid and have a quadrangular, preferably a rectangular, cross-section. In this embodiment there is ensured that the approximately cuboid joint elements rest respectively on the bottom surfaces thereof on the sliding surface and may slide thereon in the longitudinal direction of the bridge back and forth. A height of the joint element is dimensioned so that the opposite upper surface of the joint element forms a planar and thus drivable or walkable surface, which is preferably situated in the plane or inclination level of the roadway. Where required, there is achieved a corresponding construction height of the joint element, so that the upper surfaces thereof are each situated in the inclination level of the roadway, only by the application of an according asphalt cover layer onto the upper surfaces of the joint elements. According to embodiment, it is conceivable within the scope of the invention to use joint elements with substantially square cross-sections, too.

In a preferred embodiment of the invention in a roadway joint device the rod is made from a corrosion-resistant material. The at least one rod, which is anchored in the bridge as well as in a retaining device and which transfers the tensile and pressure forces onto the joint elements attached thereto if the length of the bridge is changed, is exposed, apart from a high mechanical stress, also to corrosion due to permanently changing weather conditions as well as to the influence of, for example, chemical substances and fuels. By using corrosion-resistant materials for producing each rod, the durability of an inventive roadway joint device is advantageously increased.

In a development of the invention in a roadway joint device the rod is arranged especially advantageously within a cladding tube and a space between the rod and an internal wall of the cladding tube is filled with grouting mortar. In this embodiment the internally situated rod is advantageously protected by a cladding tube surrounding it. In order to ensure that also with the use of a cladding tube the tensile and pressure forces are transferred to the joint elements if the length of the bridge structure is changed, each space between the rod and the cladding tube is filled. In this way, in the case of an expansion of the rod also the surrounding cladding tube will be expanded and the joint elements attached to the cladding tube will be moved away from each other each having an increasing joint gap.

In an inventive roadway joint device the cladding tube is usefully made from a corrosion-resistant material. In this embodiment the durability of the roadway joint device is further increased. In this way, there may also be used various materials that are not or only insufficiently resistant against corrosion as a rod material, as there is provided the appropriate protection due to the surrounding cladding tube made from a corrosion-resistant material. Especially advantageously, the materials of the rod as well as those of the surrounding cladding tubes may be configured corrosion-resistant.

In an inventive roadway joint device each joint element is preferably covered at least in some section by an asphalt cover layer, wherein the asphalt cover layer is substantially flush with the road of the roadway. As previously mentioned, it is possible within the scope of the invention to provide in a roadway joint device having numerous joint elements a continuous asphalt cover layer also in the area of the variable small joint gaps, which will remain substantially free of cracks due to the small joint gaps.

In a roadway joint device the joint elements are usefully made from in-situ concrete. In this way, joint elements may be produced appropriately in series, for example, substantially as cuboid joint elements, and these may be installed in a roadway joint device in a simple and quick way on site on a bridge construction site.

In a preferred development of the invention in a roadway joint device each joint element includes at least one prefabricated element.

In an inventive roadway joint device each prefabricated element has advantageously a recess, which recess may be filled with filling concrete. In this embodiment the joint elements are, for example, finished on site on a bridge construction site. Therefore, the prefabricated elements, which are transported correspondingly more easily due to the recesses thereof than joint elements made from full material, are filled with filling concrete on site.

In an inventive roadway joint device each prefabricated element is especially advantageously configured substantially trough-like. Due to the trough-like configuration, the recesses of the prefabricated elements may be filled with filling concrete especially easily and comfortably on site.

A preferred method for producing an inventive roadway joint device may be indicated by a sequence of the following steps:

—a— producing at least one prefabricated element having one or several recesses, wherein the prefabricated element is preferably produced substantially trough-like;

—b— where required, transporting the at least one prefabricated element to an installation location;

—c— placing the at least one prefabricated element with each of the recesses thereof facing upwards on a sliding surface, wherein the sliding surface adjoins a bridge end section of the bridge structure as well as a retaining device, which is arranged at a distance to the bridge end section within or underneath a roadway;

—d— aligning the at least one prefabricated element on the sliding surface, wherein a longitudinal axis of the prefabricated element is aligned substantially parallel to a plane of the roadway as well as substantially parallel to the bridge end section and wherein between the prefabricated element and/or the adjoining bridge end section and/or the adjoining retaining device there is placed respectively one joint gap with a specified width;

—e— anchoring at least one rod, which is guided substantially transversally to the direction of the longitudinal axis through each prefabricated element, at one rod end thereof using an anchoring in the bridge structure and at the other end thereof using an anchoring in the retaining device;

—f— sealing the feedthrough points on the internal surfaces of each recess, at which the at least one rod is guided through each prefabricated element, using respectively one sealing and —g— filling the recesses within each prefabricated element with filling concrete to respectively one joint element.

In this variant of a production method any number of rods is anchored substantially in the longitudinal direction of the bridge structure between the retaining device and a bridge end section. In the area of the feedthroughs of the rods through each prefabricated element as well as within the joint gaps, that is in the spaces between the joint elements, the rods are guided freely, in order to compensate for changes in length. In the areas within the prefabricated elements, which are each filled with filling concrete, the respective rod sections are connected with the respective joint element by compound effect between rod and joint element.

An advantageous variant of a method for producing an inventive roadway joint device may be indicated by a sequence of the following steps:

—a— producing at least one prefabricated element having one or several recesses, wherein the prefabricated element is preferably produced substantially trough-like;

—b— where required, transporting the at least one prefabricated element to an installation location;

—c— placing the at least one prefabricated element with each of the recesses thereof facing upwards on a sliding surface, wherein the sliding surface adjoins a bridge end section of the bridge structure as well as a retaining device, which is arranged at a distance to the bridge end section within or underneath a roadway;

—d— aligning the at least one prefabricated element on the sliding surface, wherein a longitudinal axis of the prefabricated element is aligned substantially parallel to a plane of the roadway as well as substantially parallel to the bridge end section and wherein between the prefabricated element and further adjoining prefabricated elements and/or the adjoining bridge end section and/or the adjoining retaining device there is placed respectively one joint gap with a specified width;

—e— attaching at least one cladding tube, which is guided substantially transversally to the direction of the longitudinal axis through each prefabricated element, at one cladding tube end thereof using an anchoring in the bridge structure and at the other cladding tube end thereof using an anchoring in the retaining device;

—f— sealing the feedthrough points on the internal surfaces of each recess, at which the at least one cladding tube is guided through each prefabricated element, with respectively one sealing;

—g— filling the recesses within each prefabricated element with filling concrete to respectively one joint element.

—h— inserting at least one rod into each cladding tube;

—i— anchoring each rod at one rod end thereof using an anchoring in the bridge structure and at the other rod end thereof using an anchoring in the retaining device, and —j— filling each of the spaces between a rod and an internal wall of the surrounding cladding tube with grouting mortar.

In this production variant the rods are advantageously protected against corrosion and weathering by means of cladding tubes.

An alternative variant of a method for producing an inventive roadway joint device is indicated by the sequence of the following steps:

—a— producing prefabricated elements having one or several recesses, wherein each prefabricated element is preferably produced substantially trough-like;

—b— where required, transporting the prefabricated elements to an installation location;

—c— lining up respectively at least two substantially trough-like prefabricated elements respectively at the front surfaces thereof on a sliding surface, wherein the prefabricated elements that are lined up at the front surfaces thereof each have the same direction of the longitudinal axis;

—d— aligning the prefabricated elements that are lined up at the front surfaces thereof on the sliding surface, wherein the longitudinal axis of the lined-up prefabricated elements is aligned substantially parallel to a plane of the roadway as well as substantially parallel to the bridge end section and wherein there is installed respectively one joint gap with a specified gap width between the lined-up prefabricated elements and further laterally adjoining prefabricated elements and/or the adjoining bridge end section and/or the adjoining retaining device;

—e— sealing joint points at the front surfaces of the lined-up prefabricated elements;

—f— placing a reinforcement in the area of the joint points at the front surfaces of the lined-up prefabricated elements;

—g— boarding the free front surface of the outmost prefabricated elements at the ends of the joint element;

—h— anchoring at least one rod or at least one rod that is guided within a cladding tube, which rod is guided substantially transversally to the direction of the longitudinal axis through at least one prefabricated element, at the one rod end thereof using an anchoring in the bridge structure and at the other rod end thereof using an anchoring in the retaining device;

—i— sealing the feedthrough points at the internal surfaces of each recess, at which the at least one rod and/or the cladding tube is guided through a prefabricated element, using respectively one sealing;

—j— filling the recesses within each prefabricated element with filling concrete to respectively one joint element, and —k— where required when using cladding tubes, filling the respective spaces between a rod and an internal wall of the surrounding cladding tube with grouting mortar.

Using such a production method it is advantageously also possible to produce inventive roadway joint devices from prefabricated elements on site also in the case of large roadway widths. According to the number of the prefabricated elements lined-up at the front surfaces thereof, respectively, there may be individually produced joint elements in various roadway widths.

In the following the invention is described by way of the embodiment examples illustrated in the figures. The invention is illustration in FIG. 1 to FIG. 11. In the schematic depictions:

Figure 6:
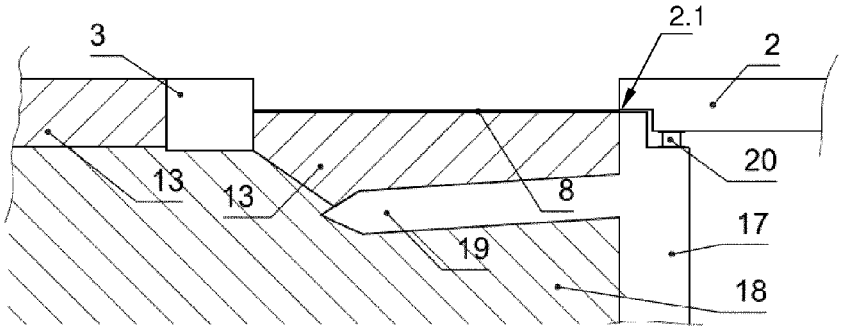
Figure 7:
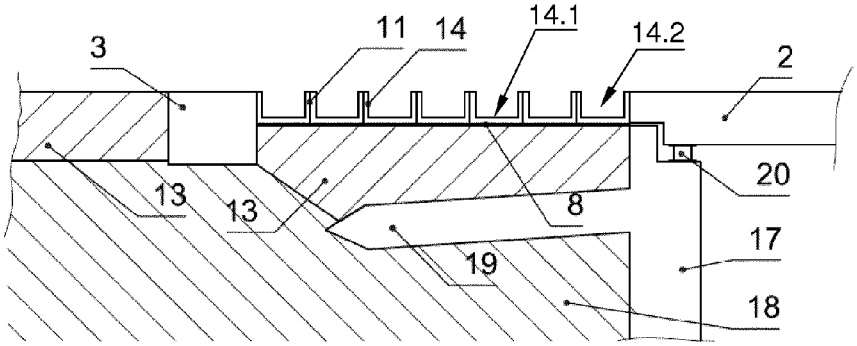
Figure 8:
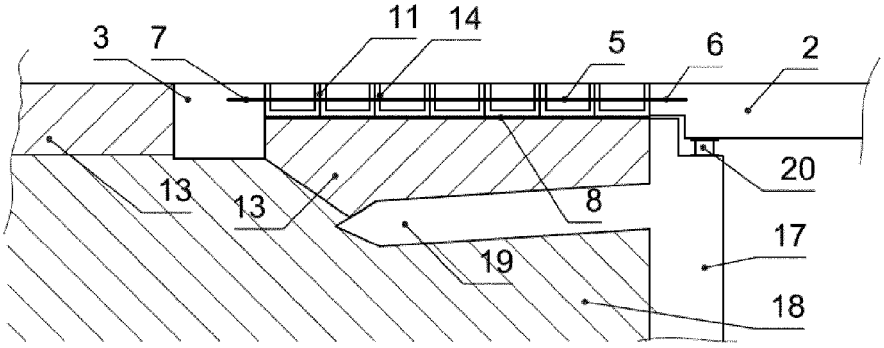
Figure 9:
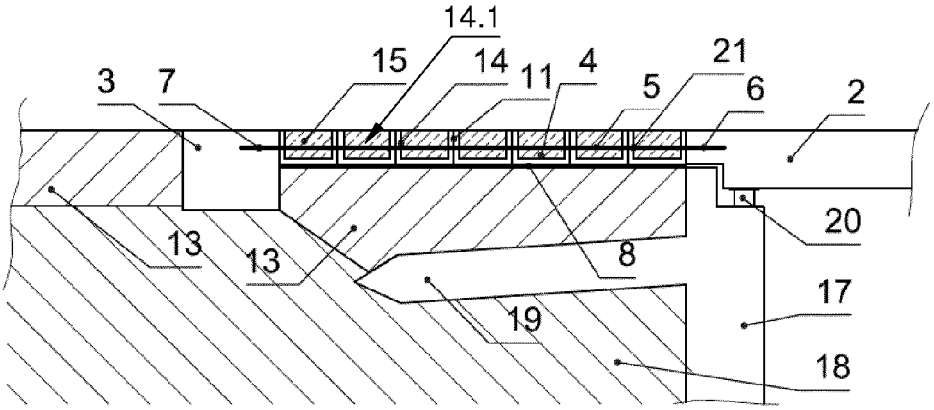
Figure 10:
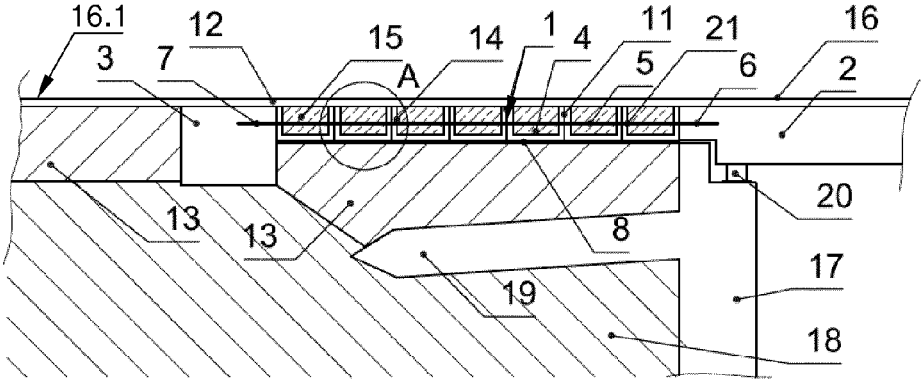
Figure 11:
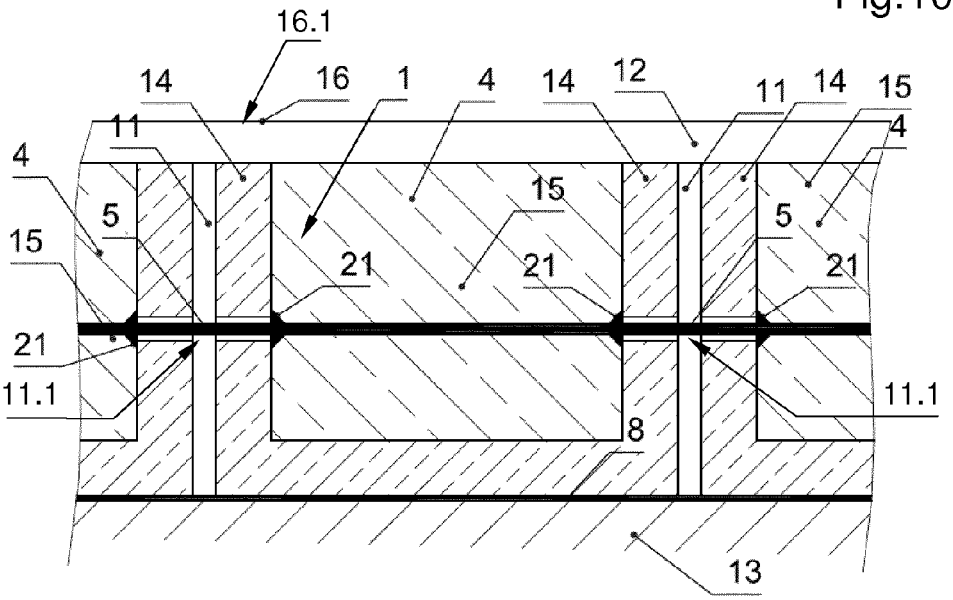

FIG. 6 to FIG. 11 each show in sectional side views different stages of a method for producing an inventive roadway joint device, wherein FIG. 6 shows an initial situation with the sliding surface already formed;

FIG. 7 shows a next method step with prefabricated parts placed on the sliding surface;

FIG. 8 shows another method step with an installed rod and boardings at the external front surfaces;

FIG. 9 shows a next production step after the introduction of filling concrete;

FIG. 10 shows a final step after the application of an asphalt cover layer as well as FIG. 11 shows the detail A of FIG. 10 in enlarged scale.

Figure 1:
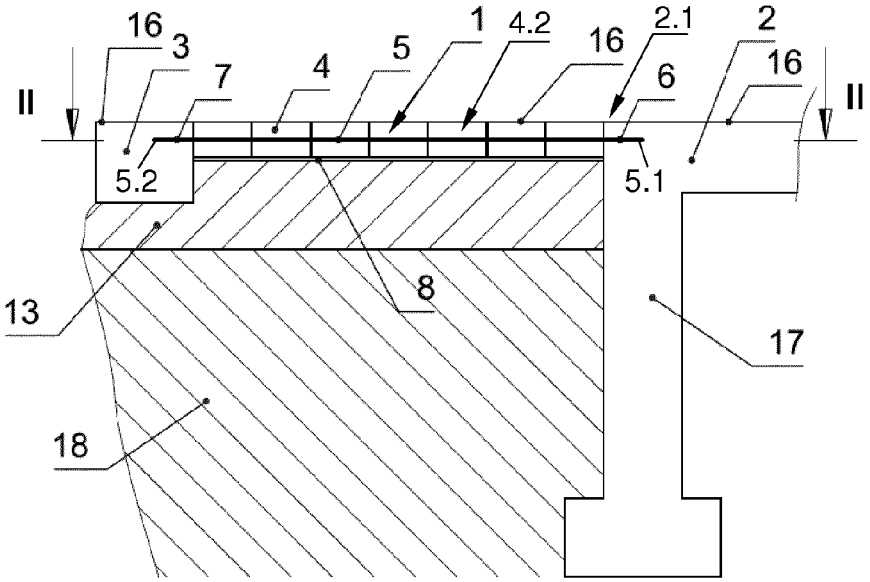
FIG. 1 shows in a vertical sectional view an overall view of a first embodiment of the inventive roadway joint device.

FIG. 1 shows a roadway joint device 1 of a bridge 2, in which a bridge superstructure is rigidly connected with an abutment and extends to a bridge end section 2.1. The bridge end section 2.1 herein forms, for example, an edge substantially transversal to the longitudinal direction of the roadway. The roadway joint device 1 further includes a retaining device 3, several joint elements 4 as well as rods 5, which are arranged through the joint elements 4 and connect the joint elements 4 with each other. Each joint element 4 in the embodiment illustrated herein in FIG. 1 has a substantially cuboid form with a longitudinal axis 4.1 as well as a quadrangular, e.g., square or rectangular, cross-section 4.2. The joint elements 4 in FIG. 1 are connected with the bridge 2, as well as with the retaining device 3, by way of the rods 5. For this purpose, a first rod end 5.1. of each rod 5 is anchored in the bridge 2 using an anchoring 6 of the rod 5. The respective opposite other rod end 5.2 of the rod 5 is attached in the retaining device 3 using an anchoring 7 of the rod 5. The rods 5 in this embodiment of the invention have to be composed of a corrosion-resistant material. Suitable materials for such rods 5 may be, e.g., stranded litzes made from rust-resistant steel, rods made from plastic materials or wire made of fibre composite materials. The bridge anchorings 6 or the retaining anchorings 7, respectively, of the rods 5 may also configured as compound anchorings. Alternatively, also anchoring systems known from reinforced concrete constructions may also be used for anchoring 6, 7 the rod ends 5.1. or 5.2, respectively.

There is further visible in FIG. 1 a sliding surface 8 already prepared, which is arranged in an area between the retaining device 3 and the bridge end section 2.1 of the bridge 2. According to FIG. 1 the approximately cuboid joint elements 4, which are herein made from concrete, are mounted on the sliding surface 8 and arranged between the retaining device 3 and the bridge 2. The sliding surface 8 may be configured, e.g., as a bituminous layer on a load-bearing layer 13.

Figure 2:
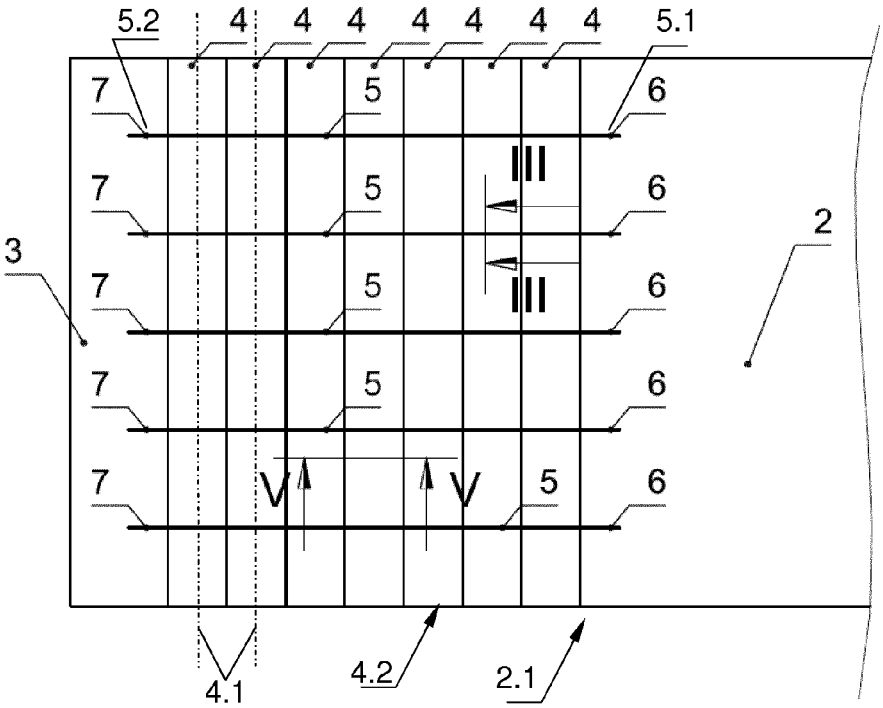
FIG. 2 shows a horizontal sectional view along the section line II-II according to FIG. 1.

There is visible in FIG. 2 that the cuboid joint elements 4 in the plan view are arranged substantially parallel to the end of the bridge 2. In the embodiment illustrated there are used, for example, seven approximately cuboid joint elements 4 each having longitudinal axes 4.1. extending substantially parallel thereto. Five rods 5 are intended for the uniform connection and load distribution, respectively, across the entire width of the roadway.

Figure 3:
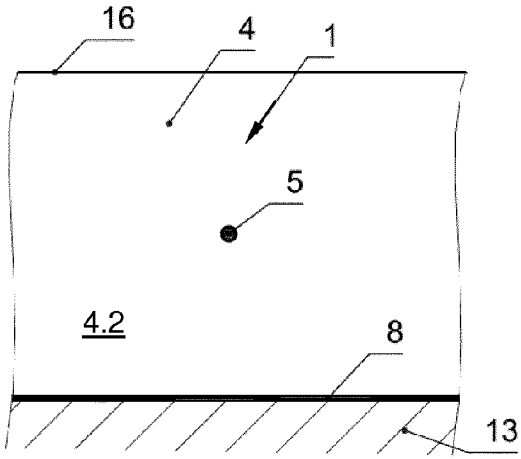
FIG. 3 shows a sectional view along the section line III-III in FIG. 2 in enlarged scale.

For the function of an inventive roadway joint device 1 a direct connection of the rod 5 with the cuboid joint element 4 that is illustrated in FIG. 3, is of importance. This direct or rigid, respectively, connection between respectively the rods 5 and each cuboid joint elements 4 is established, for example, most easily by concrete-casting the rods 5 into the cuboid joint elements 4. In this way, compound tensions from the rods 5 may be transferred to the joint elements 4 attached thereto in a uniformized way, and in this way longitudinal expansions of the bridge 2 may be compensated for.

Figure 4:
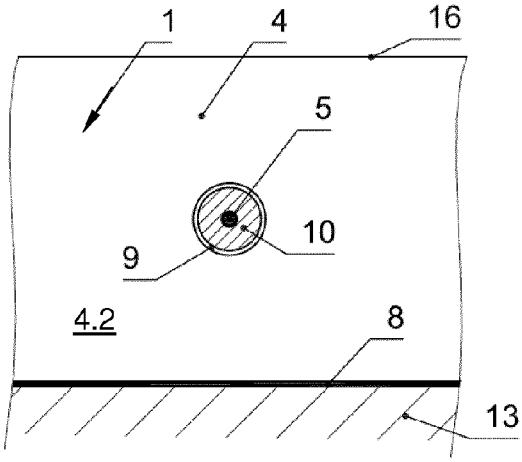
FIG. 4 shows an alternative embodiment of the invention in a sectional view comparable with FIG. 3.

An alternative embodiment of the connection between a rod 5 and a cuboid joint element 4 is illustrated in FIG. 4. If the rod 5 is made of a not corrosions-resistant material, then there is required in addition as a protection against corrosion an encapsulation of the rod 5 in a cladding tube 9, wherein the cladding tube 9 is made of a corrosion-resistant material. Suitable materials for rods 5 in this embodiment having a cladding tube 9 protected against corrosion are, for example, ropes or stranded litzes made of metallic materials. The approximately cuboid joint element 4 is therein in a respectively direct contact with a cladding tube 9, within which the rod 5 is arranged. A force-fit connection between the cladding tube 9 and the rod 5 situated therein is produced by filling with grouting mortar 10. Upon hardening the grouting mortar 10 will be able to transfer compound tensions between the cladding tube 9 and the rod 5. Hence, also in this embodiment the transfer of longitudinal expansions of the bridge 2 to the rods 5 and from these further to the joint elements 4 is ensured. The cladding tube 9 is attached with the two cladding tube ends 9.1 or 9.2, respectively, thereof also in the bridge 2 or in the retaining device 3, respectively, in the area of the anchorings 6, 7.

Figure 5:
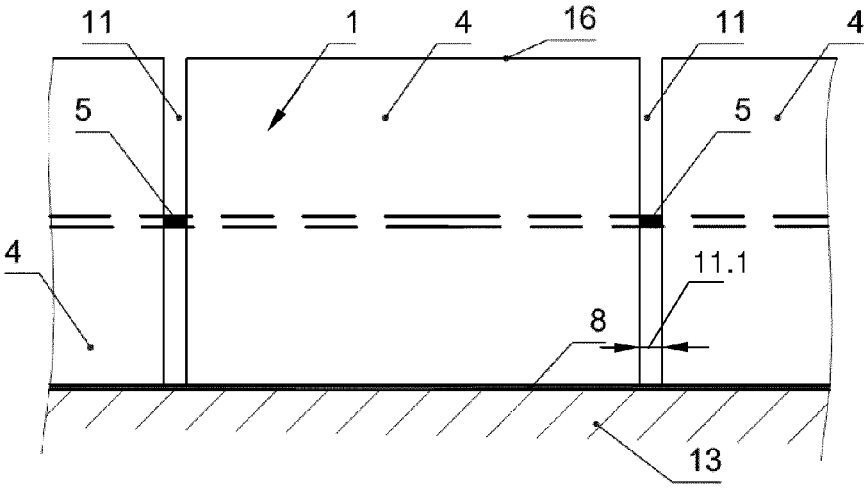
FIG. 5 shows a sectional view along the line V-V according to FIG. 2 in enlarged scale.

FIG. 5 shows in a sectional view along the line V-V from FIG. 2 the arrangement of the cuboid joint elements 4 on the sliding surface 8 in detail. Between the two neighbouring cuboid joint elements 4 there is present respectively one joint gap 11 having a gap width 11.1, in which the rod 5 is not embedded in concrete. Into the exposed joint gap 11 surface water, thawing agents and dirt may enter, which is why the embodiment of the rod 5 is required to be made of a corrosion-resistant material in order to ensure a permanent structure.

Contractions of the bridge 2, which are, for example, conditioned by a temperature decrease, will lead to an expansion of the distance between the retaining device 3 and the bridge end section 2.1 and, hence, to an expansion of the rods 5. Due to the expansion of the rods 5 there is caused an opening of the joint gaps 11 or an enlargement of the individual gap widths, 11.1, respectively, as the individual joint elements 4 are attached to the rods 5 in a direct and stationary way. The longitudinal deformation of the bridge 2 is distributed in regard to the stationary retaining devices 3 or the bridge anchorages 7 of the several rods 5, respectively, approximately uniformly by the inventive roadway joint device 1 across the, in this example eight, longitudinal gaps 11 formed, as is illustrated in FIG. 2. For example, in the case of a longitudinal deformation of the bridge 2 by in total 80 mm, the longitudinal deformations acting in total are distributed onto the number of the joint gaps 11 in a uniform way. In the case of eight joint gaps 11, the deformation of every individual joint gap 11.1 in the case of a total deformation of 80 mm will thus be respectively only 10 mm, which may be handled in a comparatively easy way.

The uniformized changes of the gap widths 11.1 are only possible if tensile and pressure forces are being developed in the rods 5. These tensile or pressure forces in the rods 5 will lead to the corresponding longitudinal changes of the rods 5. By the stationary attachment of the individual joint elements 4 along the rods 5, in the case of longitudinal deformations of the bridge 2 the joint elements 4 are appropriately moved back and forth on the sliding surface 8 between the retaining device 3 and the bridge end section 2.1, thus compensating for the entire deformation of the roadway joint device 1 and distributing or uniformizing, respectively, it onto several individual joint gaps 11 with variable joint widths 11.1.

Expansions of the bridge 2, for example as a consequence of a temperature increase, will lead to a reduction of the gap widths 11.1 of the joint gaps 11. The number of the joint gaps 11 as well as the gap widths 11.1 are to be appropriately configured when planning the roadway joint device 1. If the gap width 11.1 becomes smaller than when originally projected when producing the roadway joint device 1, then pressure tensions will be developed in the rods 5 or also in the cladding tubes 9 according to embodiment, respectively, as well as in the grouting mortar 10. In the configuration of the roadway joint device 1, hence, it is to be taken into account whether the pressure tensions may be absorbed by the rods, or whether a projected stability failure will occur, which might lead to an earlier closing of the joint gaps 11 adjacent to the bridge 2. In an embodiment with cladding tubes 9 and grouting mortar 10 there is further to be taken into account that the extensional rigidity of the roadway joint device 1 must not become too large in the case of pressure stress in the rods 5.

For the tensile forces developing, the behaviour of an inventive roadway joint device 1 may be compared with a rod made of reinforced concrete, in which cracks may be formed in the course of tensile stress. The longitudinal change of the rod made of reinforced concrete is approximately the sum of the increase in the crack widths. The concrete pieces between the cracks are exposed to a certain tensile stress due to compound tensions, which are conducted by the reinforcement rod into the concrete pieces, and thus have expansions. The extensional rigidity of the concrete pieces between the cracks, however, is many times higher than the extensional rigidity of the reinforcement rod, which is still present in the cracks.

The forces developing in the rods 5 during a deformation of the bridge 2 have to be absorbed by the retaining device 3. If the retaining device 3 is arranged, for example, on an embankment, then it is appropriately difficult to configure, or it has be anchored in the embankment using so-called geogrids or similar anchoring means. If the bridge 2, for example, is erected adjacent to a tunnel, then the retaining device 3 may also be integrated in the bottom surface of the tunnel, thus being anchored in a stationary way.

In the embodiment example illustrated herein there is present, upon completion of the bridge 2 with a drivable roadway 16 made from concrete and a roadway 16 made from concrete adjoining the roadway joint device 1, a continuous roadway surface made from concrete.

The production of an inventive roadway joint device 1 is explained in the following by way of the schematic depictions FIG. 6 to FIG. 11.

FIG. 6 shows an initial situation of a bridge 2 being mounted on the abutments 17 using bridge bearings 20. Laterally adjacent to the abutments 17 there has already been introduced a backfilling 18. Herein a so-called drag plate 19 resting on the backfilling 18 is rigidly connected with the abutment 17. On the drag plate 19 and on the backfilling 18 there is produced a load-bearing layer 13. Embedded in the load-bearing layer 13 is the retaining device 3. On the load-bearing layer 13 there is formed a sliding surface 8 between the retaining device 3 and the end of the bridge 2.

According to FIG. 7 in the next step of the production method there are placed, e.g., trough-like prefabricated elements onto the sliding surface 8 so that there will remain deliberate joint gaps 11 each having gap widths 11.1 between the trough-like prefabricated elements 14. The prefabricated elements 14 herein are made from concrete and each have longitudinal axes 14.1. The prefabricated elements 14 herein are configured substantially trough-like having a recess 14.2 and placed onto the sliding surface 8 so that the recesses 14.2 are each situated at the upper surfaces thereof.

In the following step, which is illustrated in FIG. 8, the rods 5 are installed between the retaining device 3 and the bridge 2. The rods 5 are guided substantially transversally through all trough-like prefabricated elements 14 and being anchored at respectively one rod end 5.1 thereof using bridge anchorings in the bridge 2 as well as at the opposite rod end 5.2 thereof using retaining anchorings 7 in the retaining device 3. At the ends of the trough-like prefabricated elements 14 there is attached a boarding.

In the next step according to FIG. 9 there is introduced filling concrete 15 into the trough-like prefabricated elements 14. Before the introduction of the filling concrete 15, the positions, at which the rods 5 are guided through the trough-like prefabricated elements 14, are to be sealed respectively at the internal surfaces of the trough-like prefabricated elements 14 using an appropriate sealing 21. By the introduction of filling concrete 15 into the trough-like prefabricated elements 14 there will then be formed joint elements 4, which each are directly connected with the rod 5.

Finally, according to FIG. 10 there is applied an asphalt cover layer 12. The asphalt cover layer 12 extends continuously on the load-bearing layer 13 of the embankment, on the roadway joint device 1 and on the bridge 2. The driving comfort is substantially improved by the formation of a roadway 16 having one plane 16.1, which is formed by the continuous asphalt cover layer 12, in comparison with conventional embodiments of roadway joint structures, in which the roadway in different sections is composed of respectively different materials with respectively different roadway characteristics.

The material of the continuous asphalt cover layer 12 and the uniform changes of the gap widths 11.1 of the joint gaps 11, hence, are to be carefully coordinated. An enlargement of the joint gaps 11 is to be absorbed by appropriate expansions in the asphalt cover layer 12. In the case of an intact, crack-free asphalt cover layer 12 the surface water is discharged via the asphalt cover layer 12 to the edge of the roadway 16. If there is allowed a projected formation of cracks in the asphalt cover layer 12 in the area of the variable joint gaps 11, then the sliding surface 8 situated underneath is to be embodied as a sealing plane against surface water.

FIG. 11 shows in a detailed view A according to FIG. 10 in an enlarged scale the approximately trough-like prefabricated elements 14, which have already been filled with filling concrete 15. Each rod 5 is therein in direct contact with the filling concrete 15 and connected therewith in a stationary way. Within the feedthroughs through the trough-like prefabricated elements 14 as well as in the projected joint gaps 11 the rod 5 is freely movable, which will contribute to the desired appropriately large deformations of each rod 5 within its sections that are freely movable in the case of tensile or pressure stress. In this way, there is ensured that the joint elements 4 will be moved back and forth on the sliding surface 8 without any delay in the case of longitudinal changes of the bridge 2 due to tensile or pressure stress. A jolt-like and delayed rupture of the joint gaps 11 together with a peak stress associated therewith of the continuous asphalt cover layer 12 thus will be prevented.

If the roadway width of the bridge 2 becomes too large, then it may be advantageous to produce the trough-like prefabricated elements 14 each consisting of two or more individual trough-like prefabricated elements 14 and to connect these several prefabricated elements 14 each at the front sides or front surfaces 14.3, respectively, thereof lined-up in the direction of the longitudinal axis 14.1 on the sliding surface 8. By appropriate sealing measures in this case is to be ensured that no leaking of the filling concrete 15 can occur at the joint positions between lined-up prefabricated elements 14. In such an embodiment having front-side aligned prefabricated elements 14 it may be, e.g., advantageous to arrange a reinforcement within the trough-like prefabricated elements 14 in the area of the joint points. In this way, the individual lined-up and trough-like prefabricated elements 14 are connected into a continuous, approximately cuboid joint element 4 via the reinforcement and the filling concrete 15.

By way of the illustrations FIG. 6 to FIG. 11 there was shown as an example the production of two inventive roadway joint devices 1 each having seven lined-up cuboid joint elements 4 adjacent to the two bridge end sections 2.1 of a bridge 2. The number of the joint elements 4 per roadway joint device 1 is dependent for real-life applications on the deformations to be absorbed. The number of the cuboid joint elements 4 installed in the roadway joint device 1 may, hence, range between 1 and 100. The joint elements 4 in the illustrations FIG. 7 to FIG. 11 have approximately the same dimensions. It may be advantageous to produce the joint elements 4 having different dimensions and to configure the joint element 4 adjoining the bridge 2 with an enlarged width, for example. Correspondingly, an inventive roadway joint device 1 may also be used in structural engineering as well as in civil engineering if a drivable or walkable structure surface is to be produced with simultaneous absorption of different deformations between two parts of a structure. These embodiments, however, are not explicitly depicted in the illustrations, but are nevertheless covered by the invention.

LIST OF REFERENCE NUMBERS

1 roadway joint device
2 bridge
2.1 bridge end section
3 retaining device
4 joint element
4.1 longitudinal axis of the joint element
4.2 cross-section of the joint element
5 rod
5.1 rod end (or 5.2, resp.)
6 anchoring of the rod in the bridge
7 anchoring of the rod in the retaining device
8 sliding surface cladding tube
9.1 cladding tube end (or 9.2, resp.)
10 grouting mortar
11 joint gap
11.1 gap width of the joint gap
12 asphalt cover layer
13 load-bearing layer
14 prefabricated element
14.1 longitudinal axis of the prefabricated element
14.2 recess of the prefabricated element
14.3 front side or front surface, respectively, of the prefabricated element
15 filling concrete
16 roadway
16.1 plane or inclination, respectively, of the roadway
17 abutment
18 backfilling
19 drag plate
20 bridge bearing
21 sealing

The invention claimed is:

1. A roadway joint device (1) for providing a drivable joint section between a road and a drivable adjoining structure, in particular a bridge structure (2), wherein the various deformations of the road and the adjoining structure may be compensated by the roadway joint device (1), wherein there is placed on a sliding surface (8) adjacently to the bridge structure (2) at least one joint element (4), wherein each joint element (4) comprises at least one prefabricated element (14) that has a recess (14.2), which recess (14.2) is filled with filling concrete (15), wherein the longitudinal axis (4.1) of the at least one joint element (4) is arranged substantially parallel to a plane (16.1) of the roadway (16) and substantially plane to a bridge end section (2.1) of the bridge structure (2) and joint gaps (11) with a specified width (11.1) are arranged between the at least one joint element (4) and the adjoining bridge end section (2.1) and/or an adjoining retaining device (3), which is arranged at a distance to the bridge end section (2.1) within or underneath the plane (16.1), wherein the at least one joint element (4) is attached to at least one rod (5) by way of compound effect between rod (5) and joint element (4), whereby compound tensions may be transferred from the rod in a uniformized way to the at least one joint element (4) attached thereto, said rod (5) being arranged substantially in the direction of the longitudinal axis direction of the bridge structure (2) and being anchored in the bridge structure (2) at one rod end (5.1) thereof using an anchoring (6) and in the retaining device (3) at the other rod end (5.2) thereof using an anchoring (7).

2. The roadway joint device (1) according to claim 1, wherein two or several joint elements (4) are placed substantially in parallel with each other, wherein the longitudinal axes (4.1) of each joint element (4) are each arranged substantially in parallel with a plane (16.1) of the road (16) as well as with a bridge end section (2.1) of the bridge structure (2) and wherein between the joint elements (4) there are arranged respective joint gaps (11) with a specified gap width (11.1), wherein the joint elements (4) are connected with each other by at least one rod (5), which is attached to every individual joint element (4).

3. The roadway joint device (1) according to claim 1, wherein the joint elements (4) are substantially cuboid and have a quadrangular, preferably a rectangular, cross-section (4.2).

4. The roadway joint device (1) according to claim 1, wherein the rod (5) is made from a corrosion-resistant material.

5. The roadway joint device (1) according to claim 1, wherein the rod (5) is arranged within a cladding tube (9) and that a space between the rod (5) and an internal wall of the cladding tube (9) is filled with grouting mortar (10).

6. The roadway joint device (1) according to claim 5, characterized in that the cladding tube (9) is made from a corrosion-resistant material.

7. The roadway joint device (1) according to claim 1, wherein each joint element (4) is covered at least in some sections by an asphalt cover layer (12), wherein the asphalt cover layer (12) ends substantially flush with the plane (16.1) of the roadway (16).

8. The roadway joint device (1) according to claim 1, characterized in that the prefabricated element (14) is configured substantially trough-like.

9. A method for producing a roadway joint device (1), comprising the following steps:

-a- producing at least one prefabricated element (14) having one or several recesses (14.2), wherein the prefabricated element (14) is preferably produced substantially trough-like;

-b- where required, transporting the at least one prefabricated element (14) to an installation location;

-c- placing the at least one prefabricated element (14) with each of the recesses (14.2) thereof facing upwards on a sliding surface (8), wherein the sliding surface (8) adjoins a bridge end section (2.1) of the bridge structure (2) as well as a retaining device (3), which is arranged at a distance to the bridge end section (2.1) within or underneath a roadway (16);

-d- aligning the at least one prefabricated element (14) on the sliding surface (8), wherein a longitudinal axis (14.1) of the prefabricated element (14) is aligned substantially parallel to a plane (16.1) of the roadway (16) as well as substantially parallel to the bridge end section (2.1) and wherein between the prefabricated element (14) and further adjoining prefabricated elements (14) and/or the adjoining bridge end section (2.1) and/or the adjoining retaining device (3) there is placed respectively one joint gap (11) with a specified width (11.1);

-e- anchoring at least one rod (5), which is guided substantially transversally to the direction of the longitudinal axis (14.1) through each prefabricated element (14), using at one rod end (5.1) thereof an anchoring (6) in the bridge structure (2) and at the other end (5.2) thereof an anchoring (7) in the retaining device (3);

-f- sealing the feedthrough points on the internal surfaces of each recess (14.2), at which the at least one rod (5) is guided through each prefabricated element (14), using respectively one sealing (21) and -g- filling the recesses (14.2) within each prefabricated element (14) with filling concrete (15) to respectively one joint element (4).

10. A method for producing a roadway joint device (1), comprising the following steps:

-a- producing at least one prefabricated element (14) having one or several recesses (14.2), wherein the prefabricated element (14) is preferably produced substantially trough-like;

-b- where required, transporting the at least one prefabricated element (14) to an installation location;

-c- placing the at least one prefabricated element (14) with each of the recesses (14.2) thereof facing upwards on a sliding surface (8), wherein the sliding surface (8) adjoins a bridge end section (2.1) of the bridge structure (2) as well as a retaining device (3), which is arranged at a distance to the bridge end section (2.1) within or underneath a roadway (16);

-d- aligning the at least one prefabricated element (14) on the sliding surface (8), wherein a longitudinal axis (14.1) of the prefabricated element (14) is aligned substantially parallel to a plane (16.1) of the roadway (16) as well as substantially parallel to the bridge end section (2.1) and wherein between the prefabricated element (14) and further adjoining prefabricated elements (14) and/or the adjoining bridge end section (2.1) and/or the adjoining retaining device (3) there is placed respectively one joint gap (11) with a specified width (11.1);

-e- attaching at least one cladding tube (9), which is guided substantially transversally to the direction of the longitudinal axis (14.1) through each prefabricated element (14), at one cladding tube end (9.1) thereof using an anchoring (6) in the bridge structure (2) and at the other cladding tube end (9.2) thereof using an anchoring (7) in the retaining device (3);

-f- sealing the feedthrough points on the internal surfaces of each recess (14.2), at which the at least one cladding tube (9) is guided through each prefabricated element (14), using respectively one sealing (21);

-g- filling the recesses (14.2) within each prefabricated element (14) with filling concrete (15) to respectively one joint element (4).

-h- inserting at least one rod (5) into each cladding tube (9);

-i- anchoring each rod (5) at one rod end (5.1) thereof using an anchoring (6) in the bridge structure (2) and at the other rod end (5.2) thereof using an anchoring (7) in the retaining device (3), and -j- filling each of the spaces between a rod (5) and an internal wall of the surrounding cladding tube (9) with grouting mortar (10).

11. The method for producing a roadway joint device (1) according to claim 9, further including the following steps:

-a- producing prefabricated elements (14) having one or several recesses (14.2), wherein each prefabricated element (14) is preferably produced substantially trough-like;

-b- where required, transporting the prefabricated elements (14) to an installation location;

-c- lining up respectively at least two substantially trough-like prefabricated elements (14) respectively at the front surfaces (14.3) thereof on a sliding surface (8), wherein the prefabricated elements (14) that are lined up at the front surfaces thereof each have the same direction of the longitudinal axis (14.1);

-d- aligning the prefabricated elements (14) that are lined up at the front surfaces thereof on the sliding surface (8), wherein the longitudinal axis (14.1) of the lined-up prefabricated elements (14) is aligned substantially parallel to a plane (16.1) of the roadway (16) as well as substantially parallel to the bridge end section (2.1) and wherein there is installed respectively one joint gap (11) with a specified gap width (11.1) between the lined-up prefabricated elements (14) and further laterally adjoining prefabricated elements (14) and/or the adjoining bridge end section (2.1) and/or the adjoining retaining device (3);

-e- sealing joint points at the front surfaces (14.3) of the lined-up prefabricated elements (14);

-f- placing a reinforcement in the area of the joint points at the front surfaces (14.3) of the lined-up prefabricated elements (14);

-g- boarding the respective free front surface (14.3) of the outmost prefabricated elements (14) at the ends of the joint element (4);

-h- anchoring at least one rod (5) or at least one rod (5) that is guided within a cladding tube (9), which rod (5) is guided substantially transversally to the direction of the longitudinal axis (14.1) through at least one prefabricated element (14), at the one rod end (5.1.) thereof using an anchoring (6) in the bridge structure (2) and at the other rod end (5.2) thereof using an anchoring (7) in the retaining device (3);

-i- sealing the feedthrough points at the internal surfaces of each recess (14.2), at which the at least one rod (5) and/or the cladding tube (9) is guided through a prefabricated element (14), using respectively one sealing (21);

-j- filling the recesses (14.2) within each prefabricated element (14) with filling concrete (15) to respectively one joint element (4), and -k- where required when using cladding tubes (9), filling the respective spaces between a rod (5) and an internal surface of the surrounding cladding tube (9) with grouting mortar (10).

12. The method for producing a roadway joint device (1) according to claim 10, further including the following steps:

-a- producing prefabricated elements (14) having one or several recesses (14.2), wherein each prefabricated element (14) is preferably produced substantially trough- like;

-b- where required, transporting the prefabricated elements (14) to an installation location;

-c- lining up respectively at least two substantially trough-like prefabricated elements (14) respectively at the front surfaces (14.3) thereof on a sliding surface (8), wherein the prefabricated elements (14) that are lined up at the front surfaces thereof each have the same direction of the longitudinal axis (14.1);

-d- aligning the prefabricated elements (14) that are lined up at the front surfaces thereof on the sliding surface (8), wherein the longitudinal axis (14.1) of the lined-up prefabricated elements (14) is aligned substantially parallel to a plane (16.1) of the roadway (16) as well as substantially parallel to the bridge end section (2.1) and wherein there is installed respectively one joint gap (11) with a specified gap width (11.1) between the lined-up prefabricated elements (14) and further laterally adjoining prefabricated elements (14) and/or the adjoining bridge end section (2.1) and/or the adjoining retaining device (3);

-e- sealing joint points at the front surfaces (14.3) of the lined-up prefabricated elements (14);

-f- placing a reinforcement in the area of the joint points at the front surfaces (14.3) of the lined-up prefabricated elements (14);

-g- boarding the respective free front surface (14.3) of the outmost prefabricated elements (14) at the ends of the joint element (4);

-h- anchoring at least one rod (5) or at least one rod (5) that is guided within a cladding tube (9), which rod (5) is guided substantially transversally to the direction of the longitudinal axis (14.1) through at least one prefabricated element (14), at the one rod end (5.1.) thereof using an anchoring (6) in the bridge structure (2) and at the other rod end (5.2) thereof using an anchoring (7) in the retaining device (3);

-i- sealing the feedthrough points at the internal surfaces of each recess (14.2), at which the at least one rod (5) and/or the cladding tube (9) is guided through a prefabricated element (14), using respectively one sealing (21);

-j- filling the recesses (14.2) within each prefabricated element (14) with filling concrete (15) to respectively one joint element (4), and -k- where required when using cladding tubes (9), filling the respective spaces between a rod (5) and an internal surface of the surrounding cladding tube (9) with grouting mortar (10).

* * * * *